US007222851B2

(12) United States Patent
Stromberg

(10) Patent No.: US 7,222,851 B2
(45) Date of Patent: May 29, 2007

(54) GAMES AND GAME PLAYING IMPLEMENTS THAT INCLUDE MAGNETS

(75) Inventor: Michael J. Stromberg, 1128 Toole Ave., Apt. B, Missoula, MT (US) 59802

(73) Assignee: Michael J. Stromberg, New Haven, CT (US)

( * ) Notice: Subject to any disclaimer, the term of this patent is extended or adjusted under 35 U.S.C. 154(b) by 51 days.

(21) Appl. No.: 11/122,253

(22) Filed: May 3, 2005

(65) Prior Publication Data

US 2005/0275164 A1 Dec. 15, 2005

Related U.S. Application Data

(60) Provisional application No. 60/571,670, filed on May 5, 2004.

(51) Int. Cl.
*A63F 3/00* (2006.01)

(52) U.S. Cl. ..... 273/126 A; 273/129 R

(58) Field of Classification Search ..... 273/126 R, 273/126 A, 108, 118 R, 118 A, 119 R, 119 A, 273/129 R, 129 S, 129 T, 129 V, 129 W; 446/129

See application file for complete search history.

(56) References Cited

U.S. PATENT DOCUMENTS

| | | | | |
|---|---|---|---|---|
| 2,206,318 A | | 7/1940 | Comoletti | |
| 3,090,622 A | | 5/1963 | Sire | |
| 3,214,171 A | | 10/1965 | Luchsinger | |
| 3,430,959 A | | 3/1969 | Ross et al. | |
| 3,554,549 A | | 1/1971 | Grabowski | |
| 3,764,144 A | * | 10/1973 | Arthur | 273/126 A |
| 4,200,289 A | * | 4/1980 | Bosley | 273/109 |
| 4,236,713 A | * | 12/1980 | Moreno | 273/443 |
| 5,039,099 A | * | 8/1991 | Bravo | 273/126 A |
| 5,328,188 A | | 7/1994 | Brotz | |
| 6,276,687 B1 | | 8/2001 | Lenhart | |
| 6,293,550 B1 | | 9/2001 | Zeitlin | |
| 6,402,144 B1 | | 6/2002 | Ekberg | |
| 6,439,572 B1 | | 8/2002 | Bowen | |
| 6,450,497 B1 | | 9/2002 | Bialler et al. | |
| 6,478,299 B2 | | 11/2002 | Bialler et al. | |
| 6,561,511 B1 | | 5/2003 | Vaysberg et al. | |
| 2001/0050461 A1 | | 12/2001 | Tarbell | |
| 2002/0013170 A1 | | 1/2002 | Miller et al. | |

(Continued)

FOREIGN PATENT DOCUMENTS

| | | |
|---|---|---|
| BG | 63425 | 1/2002 |

(Continued)

*Primary Examiner*—Raleigh W. Chiu

(57) ABSTRACT

Game systems and apparatuses that include magnets are disclosed herein. A game configured in accordance with one embodiment of the invention includes a playing piece having a first magnet and a shooting device having a second magnet configured to repel the first magnet. In this embodiment, the shooting device further includes a bottom portion and a chamber. The bottom portion is configured to move across a playing surface while held in contact with the playing surface. The chamber is configured to releasably hold the playing piece while the bottom portion of the shooting device is held in contact with the playing surface. In this embodiment, the game is played by holding the playing piece in the chamber with the first magnet repelling the second magnet, and releasing the playing piece to shoot it across the playing surface toward a scoring area.

24 Claims, 3 Drawing Sheets

U.S. PATENT DOCUMENTS

| | | | | |
|---|---|---|---|---|
| 2002/0058235 | A1 | 5/2002 | Dinnerstein | |
| 2002/0140167 | A1 | 10/2002 | Bialler et al. | |
| 2003/0141661 | A1 | 7/2003 | MacEachem | |
| 2005/0275164 | A1* | 12/2005 | Stromberg | 273/126 R |

FOREIGN PATENT DOCUMENTS

| | | |
|---|---|---|
| CA | 2274474 | 7/2003 |
| GB | 251359 | 5/1926 |
| GB | 316029 | 7/1929 |
| GB | 386778 | 1/1933 |
| GB | 428318 | 5/1935 |
| GB | 441552 | 1/1936 |
| GB | 481177 | 5/1936 |
| GB | 448133 | 6/1936 |
| GB | 481442 | 3/1938 |
| GB | 536571 | 5/1941 |
| GB | 580925 | 9/1946 |
| GB | 599448 | 3/1948 |
| GB | 633951 | 12/1949 |
| GB | 669125 | 3/1952 |
| GB | 701847 | 1/1954 |
| GB | 741131 | 11/1955 |
| GB | 761345 | 11/1956 |
| GB | 841538 | 7/1960 |
| GB | 864921 | 4/1961 |
| GB | 891292 | 3/1962 |
| GB | 926079 | 5/1963 |
| GB | 934553 | 8/1963 |
| GB | 947323 | 1/1964 |
| GB | 951296 | 3/1964 |
| GB | 963628 | 7/1964 |
| GB | 1018757 | 2/1966 |
| GB | 1048472 | 11/1966 |
| GB | 1064383 | 4/1967 |
| GB | 2363730 | 1/2002 |
| RU | 2206360 | 6/2003 |
| WO | WO-03/015879 | 2/2003 |

* cited by examiner

GAMES AND GAME PLAYING IMPLEMENTS THAT INCLUDE MAGNETS

CROSS REFERENCE TO RELATED APPLICATIONS

This application claims the benefit of U.S. Provisional Patent Application Ser. No. 60/571,670, entitled "KINETIGO SHUCKING BOARD GAME," filed May 5, 2004, which is incorporated into this application by reference.

TECHNICAL FIELD

The following disclosure relates generally to games and, more particularly, to board games of skill involving movable components.

BACKGROUND

Conventional tabletop games such as air hockey and shuffleboard have been around for a long time. In an age of video games, these games provide a refreshing alternative that allows both young and old alike an opportunity to compete and interact on a three-dimensional level.

Tabletop games usually consist of one or more movable components that are manipulated by players in an arena of play. In shuffleboard, for example, the players slide metal pucks over the playing surface to position them within scoring zones at the far end of the board. The skill lies in judging the distance correctly and carefully positioning the puck at the far end of the long board. After all the pucks have been played from one end of the board, play continues in the opposite direction. The winner is the first player to accumulate a preset number of points (e.g., 15 points).

SUMMARY

This summary is provided for the benefit of the reader only, and is not meant to limit the invention as set forth by the claims in any way.

The present invention is directed generally toward systems, apparatuses, and methods for playing games. A game configured in accordance with one aspect of the invention includes a playing piece and a hand-held shooting device. The playing piece includes a first magnet and the shooting device includes at least a second magnet. The second magnet is configured to repel the first magnet and move the playing piece over a playing surface of the game. In one embodiment, the game can further include a third magnet fixedly positioned proximate to the playing surface. In this embodiment, the third magnet is configured to repel the first magnet and effect movement of the playing piece over the playing surface.

A game configured in accordance with another aspect of the invention includes a shooting device configured to move a playing piece over a playing surface from a shooting area toward a scoring area. The shooting device includes a bottom portion, a chamber, and at least a first magnet. The bottom portion of the shooting device is configured to facilitate movement of the shooting device across the playing surface. The chamber is configured to releasably hold the playing piece when the bottom portion of the shooting device is held in contact with the playing surface. The first magnet is positioned proximate to the chamber, and is configured to repel a second magnet associated with the playing piece. The repulsion between the first and second magnets causes the playing piece to move across the playing surface when released from the chamber.

A method for playing a game in accordance with a further aspect of the invention includes positioning a playing piece in a shooting device, aiming the shooting device, and releasing the playing piece on a playing surface. The playing piece includes a first magnet and the shooting device includes a second magnet configured to repel the first magnet. As a result, releasing the playing piece from the shooting device causes it to move across the playing surface. In one embodiment, releasing the playing piece includes manually releasing the playing piece. In another embodiment, aiming the shooting device includes sliding the shooting device across the playing surface and pointing it in the general direction of a third magnet fixedly attached proximate to the playing surface.

DETAILED DESCRIPTION

The following disclosure describes various game systems, game methods, and game apparatuses that include magnets. Certain details are set forth in the following description to provide a thorough understanding of various embodiments of the invention. Other details describing well-known aspects of magnets and game apparatus manufacturing techniques are not set forth below, however, to avoid unnecessarily obscuring the description of the various embodiments of the invention.

Many of the details, dimensions, angles and other features shown in the Figures are merely illustrative of particular embodiments of the invention. Accordingly, other embodiments can have other details, dimensions, angles and features without departing from the spirit or scope of the present invention. Furthermore, additional embodiments of the invention can be practiced without several of the details described below.

In the Figures, identical reference numbers identify identical or at least generally similar elements. To facilitate the discussion of any particular element, the most significant digit or digits of any reference number refer to the Figure in which that element is first introduced. For example, element 110 is first introduced and discussed with reference to FIG. 1.

Figure 1:
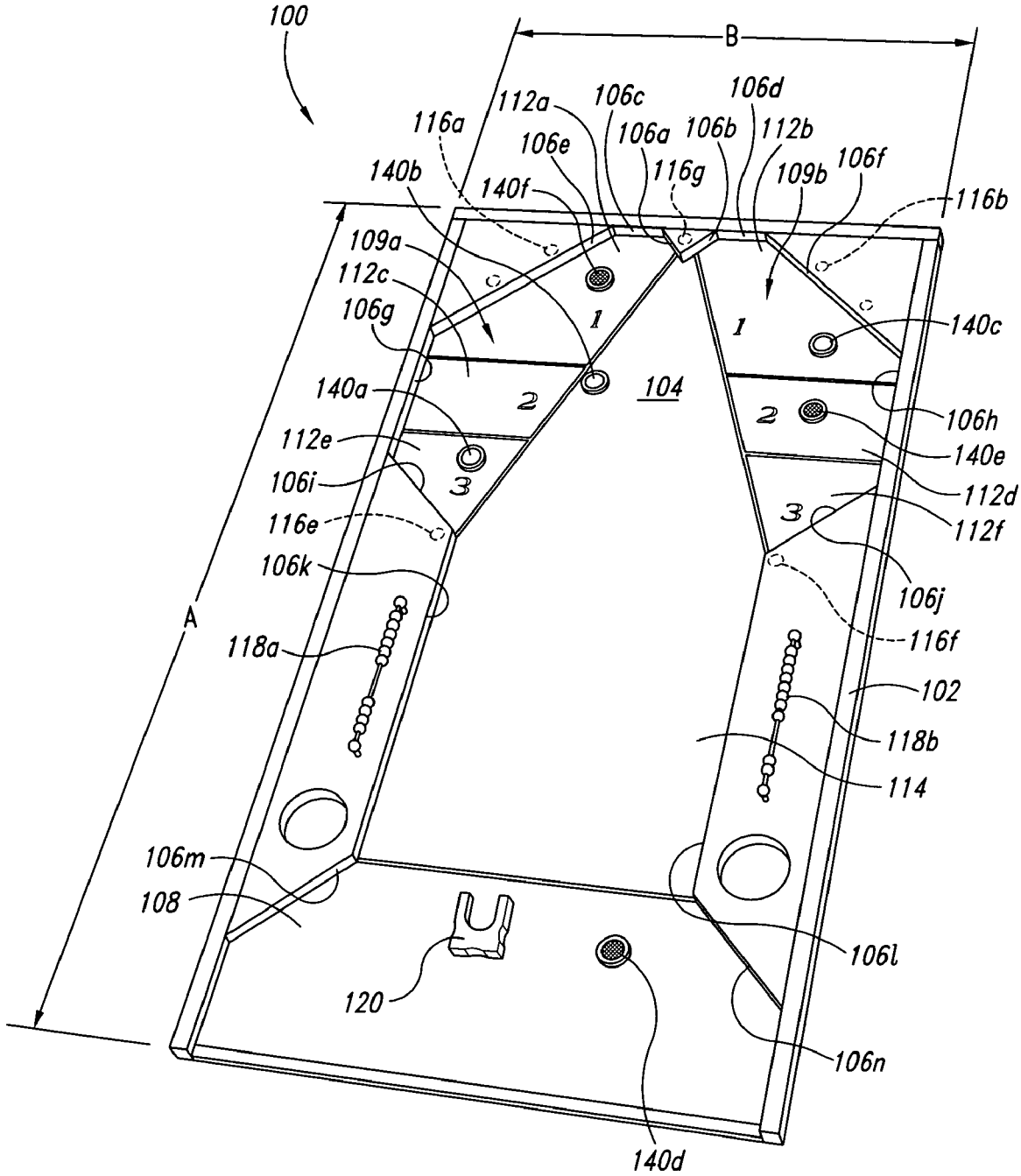
FIG. 1 is an isometric view of a game configured in accordance with an embodiment of the invention.

FIG. 1 is an isometric top view of a game 100 configured in accordance with an embodiment of the invention. In one aspect of this embodiment, the game 100 includes a board 102, a shooter 120, and a plurality of playing pieces or pucks 140 (identified individually as pucks 140*a–f*). The board 102 includes a plurality of raised wall portions 106 (identified individually as wall portions 106*a–n*) that enclose a generally smooth playing surface 104. The playing surface 104 includes an alley 114 that extends between a shooting area

108 and two scoring areas 109 (identified individually as a first scoring area 109*a* and a second scoring area 109*b*). Each of the scoring areas 109 is divided into a plurality of individual scoring zones 112 (identified individually as first scoring zones 112*a–b*, second scoring zones 112*c–d*, and third scoring zones 112*e–f*). A plurality of magnets 116 (identified individually as magnets 116*a–g*) are embedded in the board 102 adjacent to the wall portions 106*a–b, e–d*, and *i–j*.

In the illustrated embodiment, the board 102 can have a length A of about four feet, e.g., about 49.5 inches, and a width B of about two feet, e.g., about 25.5 inches. In other embodiments, the board 102 can have other dimensions depending on various factors including the particular game format, portability, and cost. In a further embodiment, the board 102 can be omitted and games at least generally similar in structure and function to the games described herein can be played on a mat or other surface which may or may not include boundaries identifying shooting and scoring areas.

The board 102 can be manufactured from a number of different materials to suit different cost and design parameters. For example, in one embodiment, the board 102 can be manufactured from wood using conventional techniques to provide an attractive, natural finish. In addition, woods of different color can be used to provide graphics or other markings on the playing surface 104. In other embodiments, the board 102 can be manufactured from various types of metal, plastic and/or synthetic materials. Various types of surface finishes (e.g., wax) can be applied to the playing surface 104 to facilitate puck movement. Glass "sand" or similar products can also be applied to the playing surface 104 for this purpose.

Figure 2:
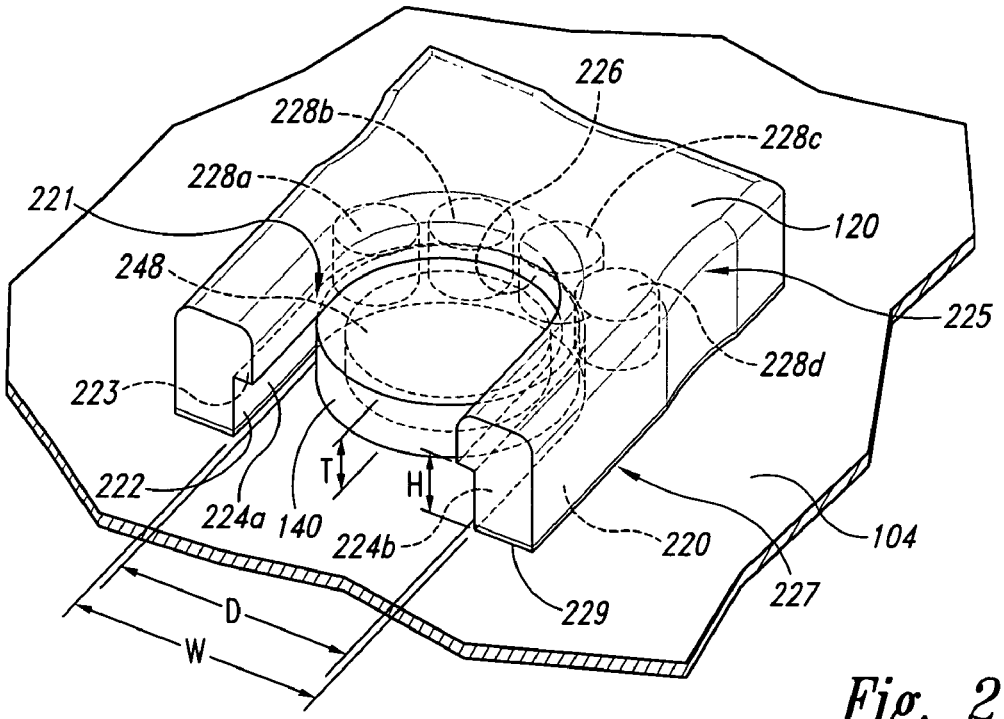
FIG. 2 is an enlarged isometric view of a shooting device and playing piece from the game of FIG. 1.

FIG. 2 is an enlarged isometric view illustrating the shooter 120 and one of the pucks 140 (in this case, the puck 140*a*) from the game 100 of FIG. 1. In one aspect of this embodiment, the shooter 120 includes a body portion 225 and a bottom portion 227. The body portion 225 includes a chamber 222 configured to releasably hold the puck 140*a* in the manner shown. In the illustrated embodiment, the chamber 122 is at least generally U-shaped and includes a back wall portion 226 and opposing side wall portions 224 (identified individually as a first side wall portion 224*a* and a second side wall portion 224*b*). The side wall portions 224 are spaced apart by a width W that is only slightly larger than a diameter D of the puck 140*a*. As described in greater detail below, the slight clearance allows the puck 140*a* to slide easily out of the chamber 222 when released.

In the illustrated embodiment, the width W is about 1.5 inches and the diameter D is about 1.375 inches. In other embodiments, however, the width W can be less than or greater than 1.5 inches, and the diameter D can be less than or greater than 1.375 inches. In still further embodiments, the chamber 222 and the puck 140*a* can have other shapes. For example, in one embodiment, the puck 140*a* or variations thereof can be at least approximately rectangular in shape. Accordingly, the present invention is not limited to the particular chamber/puck configuration illustrated in FIG. 2, but extends to all configurations falling within the scope of the claims.

The chamber 222 can include a retaining feature 221 that holds the puck 140*a* at least proximate to the playing surface 104. In the illustrated embodiment, the retaining feature 221 includes a lip 223 that extends inwardly from an upper edge of the side wall portions 224. The lip 223 is positioned a height H above a base surface 220 of the body portion 225. The height H is slightly greater than a thickness T of the puck 140*a*. The slight clearance between the puck 140*a* and the lip 223 allows the puck 140*a* to slide easily out of the chamber 222 when released.

In the illustrated embodiment, the thickness T is about 0.31 inch, and the height H is about 0.37 inch. In other embodiments, the thickness T can be less than or greater than 0.31 inch, and the height H can be less than or greater than 0.37 inch. In still further embodiments, the chamber 222 can include retaining features other than the lip 223, or the retaining feature 221 can be omitted altogether.

In another aspect of this embodiment, the bottom portion 227 is configured to facilitate movement of the shooter 120 across the playing surface 104 while the puck 140*a* is held in the chamber 222. In this regard, the bottom portion 227 can include a layer of friction-reducing material 229, such as felt, that is bonded or otherwise attached to the base surface 220 of the body portion 225. In other embodiments, the bottom portion 227 can include other friction-reducing means or materials. For example, in one such embodiment, the bottom portion 227 can include one or more roller devices (not shown). In still further embodiments, the friction-reducing material 229 can be omitted and the shooter 120 can be configured to move across the playing surface 104 on all or a portion of the base surface 220. In such embodiments, all or a portion of the base surface 220 can be contoured, polished, etc. to facilitate movement of the shooter 120 over the playing surface 104.

In yet another aspect of this embodiment, the shooter 120 further includes a plurality of magnets 228 (identified individually as shooter magnets 228*a–d*) positioned proximate to the puck chamber 222. The shooter magnets 228 are configured to repel a puck magnet 248 positioned within the puck 140*a*. Specifically, in this embodiment, each of the shooter magnets 228 is arranged so that its positive pole is positioned adjacent to the positive pole of the puck magnet 248, and its negative pole is positioned adjacent to the negative pole of the puck magnet 248, when the puck 140*a* is properly positioned in the chamber 222. As described in greater detail below, the puck 140*a* can include graphics and/or other indicia to ensure that it is loaded into the chamber 222 in the proper orientation with the magnets aligned in the foregoing manner.

The shooter magnets 228 and the puck magnet 248 can include various types of magnetic materials. In one embodiment, for example, these magnets can include rare earth magnets (e.g., neodymium-iron-boron or "NdFeB" magnets). In other embodiments, the shooter magnets 228 and the puck magnet 248 can include other types of magnets including, for example, Samarium Cobalt (SmCo), Alnico, and/or Ceramic or Ferrite permanent magnets.

Figure 3:
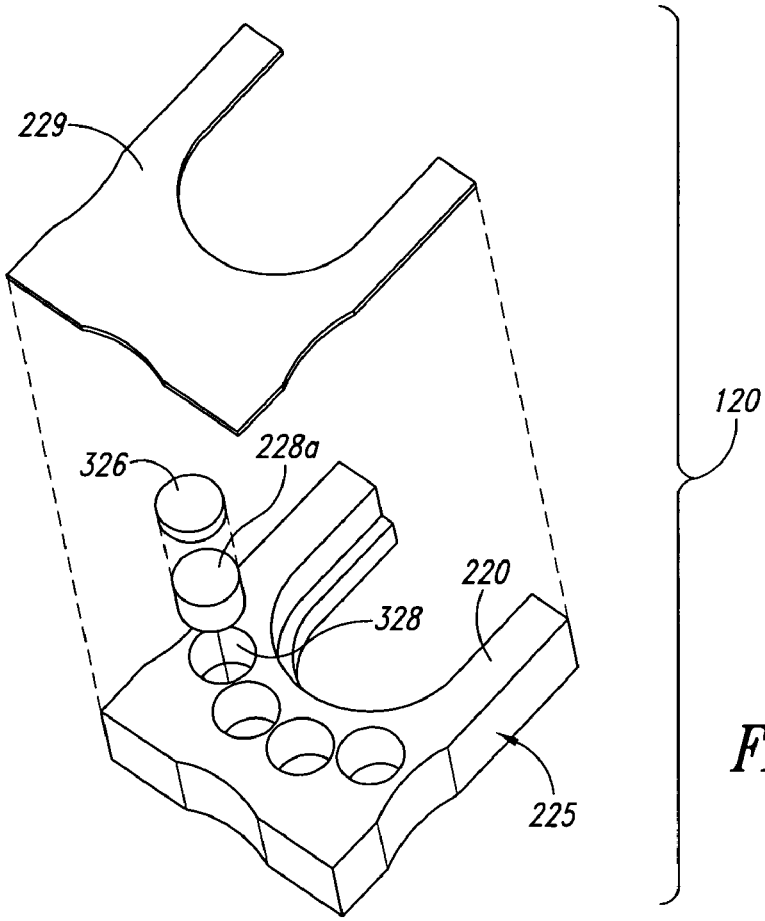
FIG. 3 is an exploded bottom isometric view of the shooting device of FIG. 2 configured in accordance with an embodiment of the invention.

FIG. 3 is an exploded bottom isometric view of the shooter 120 configured in accordance with an embodiment of the invention. As this view illustrates, each of the shooter magnets 228 is held in a corresponding bore 328 in the body portion 225. The magnets 228 can be held in place by a plug of suitable material and/or adhesive 326 (e.g., wood glue). Once each of the magnets 228 has been suitably installed in the body portion 225, the layer of friction-reducing material 229 (e.g., felt) can be bonded or otherwise attached to the base surface 220. As discussed above with regard to the board 102 (FIG. 1), in one embodiment, the body portion 225 of the shooter 120 can be fashioned from wood. In other embodiments, the body portion 225 can be molded from plastic or other suitable material.

Figure 4:
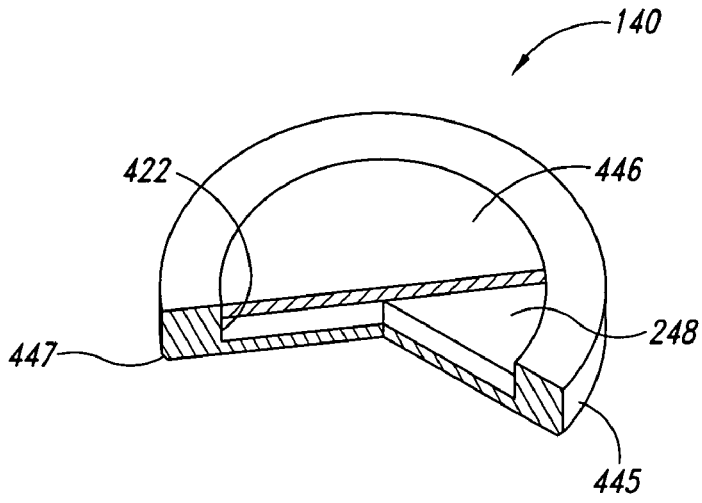
FIG. 4 is a partially cutaway isometric view of the playing piece of FIG. 2 configured in accordance with another embodiment of the invention.

FIG. 4 is a partially cutaway isometric view of the puck 140*a* configured in accordance with an embodiment of the invention. In one aspect of this embodiment, the puck 140*a* includes a cylindrical body 445 having a cavity 442 configured to receive the magnet 248. The magnet 248 can be held in place by a suitable plug or disk 446 that is bonded to the body 445. In the illustrated embodiment, the disk 446 can be colored or have other markings to distinguish it from pucks of the opposing player. For example, in one embodiment described below, the three pucks 140*a–c* of FIG. 1 can have white disks 446, while the other three pucks 140 *d–f* can have black disks 446. The puck body 445 can have a beveled edge 447 around the base to facilitate smooth sliding over the playing surface.

There are a number of suitable methods for manufacturing the puck 140*a*. In one embodiment, for example, the puck body 445 and the disk 446 can be machined out of a shatter-proof plastic (e.g., Lexan®) and bonded together with a suitable adhesive. In another embodiment, the puck body 445 and/or the disk 446 can be injection-molded from Lexan® or another suitable type of plastic. In a further embodiment, the puck body 445 and/or the disk 446 can be manufactured from wood. In yet another embodiment, the puck body 445 and the disk 446 can be omitted and the puck 140*a* can consist of only the magnet 248.

Figure 5:
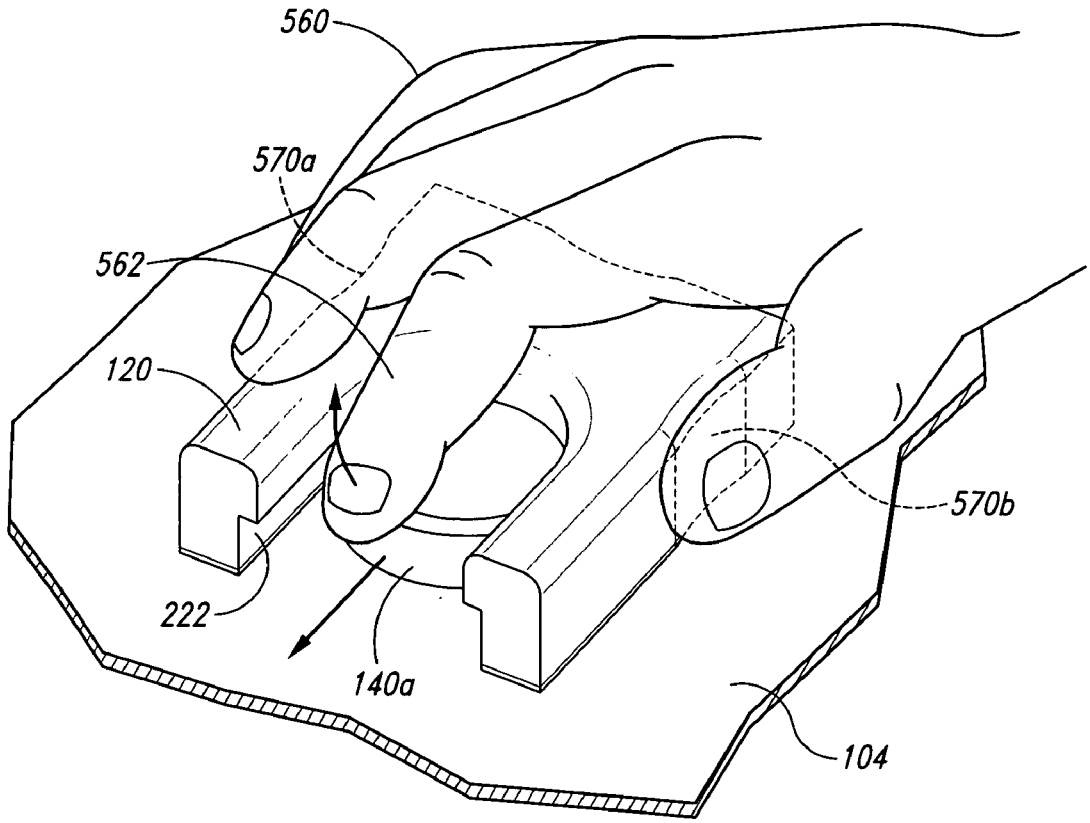
FIG. 5 is an isometric view illustrating a method of using the shooting device of FIG. 2.

FIG. 5 is an isometric view illustrating a method of using the shooter 120 in accordance with an embodiment of the invention. In this embodiment, a player grasps the shooter 120 in his hand 560, and loads the puck 140*a* into the chamber 222 while holding the shooter 120 against the playing surface 104. The body portion 225 of the shooter 120 can include one or more scallops 570 or other features to improve the player's grip. While holding the puck 140*a* in place with his or her finger(s) 562, the player slides the shooter 120 across the playing surface 104 and aims it at one of the scoring areas 109 (FIG. 1). The player then releases his or her finger(s) 562 to fire the puck 140 at the desired location.

Returning now to FIG. 1, the game 100 can be played by two players (not shown) in one embodiment as follows. First, each player selects a puck color. For example, the first player might select the three white pucks 140*a–c* and the second player might select the three black pucks 140*d–f*. The players then collect their pucks 140 in the shooting area 108 and take turns shooting them into the scoring areas 109 as described above with reference to FIG. 5. The scores are counted after all six pucks have been shot. A puck positioned in one of the first scoring zones 112*a* or 112*b* is worth one point, a puck positioned in one of the second scoring zones 112*c* or 112*d* is worth two points, and a puck positioned in one of the third scoring zones 112*e* or 112*f* is worth three points. Once the players have shot all six pucks 140, they clear the pucks 140 from the scoring areas 109 and shoot again. Each player can keep track of his or her score with a dedicated scoring mechanism 118 (identified individually as a first scoring mechanism 118*a* and a second scoring mechanism 118*b*). In the illustrated embodiment, the scoring mechanisms 118 are simple bead-type counters. In other embodiments, other types of scoring mechanisms, such as a dial-type scoring mechanism, can be used with the game 100.

The object of the game is to be the first player to score a preset number of points (e.g., 20 points) by landing your pucks in the scoring zones 112. When a player reaches 20 (or whatever final score the players agree to), he or she wins. However, the player cannot go over 20. That is, the player must shoot the precise final score needed to arrive at a total score of 20. If the player goes over 20, then no score is added and the player starts the next round of shooting with their previous score. If players tie at 20, then they proceed to a sudden death match in which the highest scoring player wins.

One feature of the game 100 described above is that the puck-to-puck repulsion caused by the puck magnets 248 (FIG. 2), and the puck-to-wall repulsion caused by the puck magnets 248 and the wall magnets 116, affects the path of the pucks 140 as they move into the scoring areas 109. For example, this repulsion enables one player to knock another player's puck out of a scoring zone without actually making contact with the other player's puck. This magnetic interplay adds an element of skill and excitement to the game 100 that is lacking in conventional games.

The present invention and various aspects thereof are by no means limited to the particular embodiments described above with reference to FIGS. 1–5. For example, although FIG. 1 depicts one possible board layout, in other embodiments, other games using implements at least generally in similar in structure and function to the implements described herein can have other layouts without departing from the spirit or scope of the present invention. Such games can include, for example, other scoring zone layouts, other scoring schemes, and other playing surface geometries.

In addition, the types of games that can use playing implements (e.g., shooters, pucks and boards) configured in accordance with embodiments of the present invention are virtually limitless. For example, another game that can use a magnetic shooting device at least generally similar in structure and function to the shooter 120 disclosed herein can have a baseball format. Other games can have first-person shooter formats, golf formats, soccer formats, etc.

Furthermore, although the shooter 120 described above with reference to FIG. 2 can be manually operated, in other embodiments, other shooting devices at least generally similar in structure and function to the shooting devices described herein can be all or partially activated by a mechanical, or an electromechanical release mechanism.

From the foregoing, it will be appreciated that specific embodiments of the invention have been described herein for purposes of illustration, but that various modifications may be made without deviating from the spirit and scope of the invention. For example, aspects of the invention described in the context of particular embodiments may be combined or eliminated in other embodiments. Further, while advantages associated with certain embodiments of the invention have been described in the context of those embodiments, other embodiments may also exhibit such advantages, and not all embodiment need necessarily exhibit such advantages to fall within the scope of the invention. Accordingly, the invention is not limited, except as by the appended claims.

I claim:

1. A game comprising:

a playing surface;

a playing piece having a first magnet; and a hand-held shooting device having at least a second magnet and a chamber configured to receive the playing piece, wherein the second magnet is configured to repel the first magnet and move the playing piece across the playing surface.

2. The game of claim 1 wherein the playing surface has at least one scoring area spaced apart from a shooting area, and wherein the shooting device is configured to move the playing piece across the playing surface from the shooting area toward the scoring area.

3. The game of claim 1 wherein the playing surface has at least one scoring area spaced apart from a shooting area, wherein the scoring area is divided into a plurality of scoring zones, and wherein the shooting device is configured to slide the playing piece across the playing surface from the shooting area toward the scoring zones.

4. The game of claim 1 wherein the shooting device includes a bottom portion configured to move across the playing surface while in contact with the playing surface.

5. The game of claim 1 wherein said chamber having a first sidewall spaced apart from a second sidewall, and wherein the playing piece is configured to fit between the first and second sidewalls.

6. The game of claim 1 wherein said chamber having a first sidewall spaced apart from a second sidewall, and wherein the playing piece has a diameter configured to fit between the first and second sidewalls.

7. The game of claim 1 wherein the shooting device includes an open portion through which a player can manually restrain the playing piece in said chamber of the shooting device.

8. A game comprising:

a playing surface;

a playing piece having a first magnet;

a hand-held shooting device having at least a second magnet, wherein the second magnet is configured to repel the first magnet and move the playing piece across the playing surface; and at least a third magnet fixedly positioned proximate to the playing surface, wherein the third magnet is configured to repel the first magnet and affect movement of the playing piece over the playing surface.

9. A game comprising:

a playing surface;

a playing piece having a first magnet;

a hand-held shooting device having at least a second magnet, wherein the second magnet is configured to repel the first magnet and move the playing piece across the playing surface;

a wall positioned adjacent to the playing surface; and at least a third magnet fixedly positioned proximate to the wall, wherein the third magnet is configured to repel the first magnet and move the playing piece away from the wall.

10. A game comprising:

a playing surface;

a playing piece having a first magnet;

a hand-held shooting device having at least a second magnet, wherein the second magnet is configured to repel the first magnet and move the playing piece across the playing surface; and wherein the playing piece is a first playing piece of a first player, and wherein the game further comprises a second playing piece of a second player, the second playing piece having a third magnet, wherein the second magnet of the shooting device is configured to repel the third magnet and move the second playing piece over the playing surface.

11. A game comprising:

a playing board having a playing surface with at least one scoring area spaced apart from a shooting area;

at least one playing piece configured to slide across the playing surface, the playing piece having a first magnet; and a shooting device, the shooting device including:

a bottom portion configured to be moved across the playing surface while held in contact with the playing surface;

a chamber configured to releasably hold the playing piece while the bottom portion of the shooting device is held in contact with the playing surface; and a second magnet positioned proximate to the chamber, wherein the second magnet is configured to repel the first magnet and thereby drive the playing piece across the playing surface from the shooting area toward the scoring area.

12. The game of claim 11 wherein the playing board further includes at least a third magnet fixedly positioned proximate to the scoring area, wherein the third magnet is configured to repel the first magnet and affect movement of the playing piece over the playing surface.

13. The game of claim 11 wherein the board further includes a raised wall portion and at least a third magnet, wherein the raised wall portion is positioned adjacent to the scoring area and the third magnet is fixedly positioned proximate to the raised wall portion, and wherein the third magnet is configured to repel the first magnet and push the playing piece away from the raised wall portion.

14. A device for moving a playing piece in a game, the device comprising:

a chamber configured to receive the playing piece;

an opening into the chamber; and at least a first magnet positioned proximate to the chamber, wherein the first magnet is configured to repel a second magnet in the playing piece and thereby drive the playing piece out of the chamber through the opening.

15. The device of claim 14 wherein the game includes a playing surface, and wherein the device further comprises a bottom portion configured to be moved across the playing surface while the chamber holds the playing piece in contact with the playing surface.

16. The device of claim 14 wherein the chamber has a first sidewall spaced apart from a second sidewall, and wherein the playing piece is configured to fit between the first and second sidewalls.

17. The device of claim 14 wherein the opening is a first open portion, and wherein the device further comprises a second open portion through which a player can manually restrain the playing piece in the chamber.

18. The device of claim 14 wherein the first magnet is configured to repel the playing piece in a first direction out of the opening, and wherein the chamber includes a restraining feature configured to restrict movement of the playing piece in a second direction perpendicular to the first direction.

19. A method for playing a game, the method comprising:

positioning a playing piece in a shooting device, the playing piece having a first magnet and the shooting device having a second magnet configured to repel the first magnet;

restraining the playing piece in the shooting device with the first magnet oriented in a manner to be repelled by the second magnet in the shooting device;

aiming the shooting device; and releasing the playing piece from the shooting device.

20. The method of claim 19 wherein releasing the playing piece includes manually releasing the playing piece.

21. The method of claim 19 wherein aiming the shooting device includes moving the shooting device across a playing surface of the game.

22. The method of claim 19 wherein aiming the shooting device includes sliding the shooting device across a playing surface of the game while the playing piece is held in contact with the playing surface.

23. A method for playing a game, the method comprising:

positioning a playing piece in a shooting device, the playing piece having a first magnet and the shooting device having a second magnet configured to repel the first magnet;

aiming the shooting device at least approximately toward a third magnet fixedly attached proximate to a playing surface of the game; and releasing the playing piece from the shooting device.

24. A method for playing a game, the method comprising:

positioning a first playing piece in a shooting device, the first playing piece having a first magnet and the shooting device having a second magnet configured to repel the first magnet;

aiming the shooting device;

releasing the first playing piece from the shooting device; and loading a second playing piece into the shooting device and shooting it toward the first playing piece on a playing surface of the game.

* * * * *